US006036480A

United States Patent [19]

Hughes et al.

[11] Patent Number: 6,036,480

[45] Date of Patent: Mar. 14, 2000

[54] COMBUSTION BURNER FOR A WATER HEATER

[75] Inventors: Dennis R. Hughes, Hartford; David W. Kramer, Milwaukee, both of Wis.; Darryl L. Ruark, Lugoff, S.C.; Gary J. Potter, Mooresville, Ind.; Martin P. McCathern, Bishopville; Peter J. Phillip, Fort Mill, both of S.C.

[73] Assignee: AOS Holding Company, Wilmington, Del.

[21] Appl. No.: 09/053,183

[22] Filed: Apr. 1, 1998

Related U.S. Application Data

[63] Continuation-in-part of application No. 08/831,176, Apr. 2, 1997, and application No. 08/602,303, Feb. 16, 1996, Pat. No. 5,735,237.

[51] Int. Cl.[7] ..... F23D 14/46

[52] U.S. Cl. ..... 431/353; 431/354; 431/263; 126/361; 126/360 R; 126/350 R; 122/250 R; 122/249; 122/13.1

[58] Field of Search ..... 431/353, 350, 431/354, 263, 243, 8, 185, 188, 182, 183, 18; 126/360 R, 360 A, 361, 350 R, 391, 103; 122/13.1, 13.2, 14, 17, 18, 19, 367.1, 367.2, 33, 249, 250 R

[56] References Cited

U.S. PATENT DOCUMENTS

| | | | |
|---|---|---|---|
| 1,102,510 | 7/1914 | Irish | 431/183 |
| 1,507,886 | 9/1924 | Hiles | 239/404 |
| 1,681,061 | 8/1928 | Seaboalt | 122/250 R |
| 1,991,186 | 2/1935 | Williams | 122/136 |
| 2,147,046 | 2/1939 | Leoni | 122/15 |
| 2,174,533 | 10/1939 | See et al. | 158/1 |
| 2,247,768 | 7/1941 | Huwyler | 431/188 |
| 2,375,840 | 5/1945 | Ekstrom, Jr. | 126/360 |
| 2,543,033 | 2/1951 | Little | 126/103 |
| 2,581,316 | 1/1952 | Wolfersperger | 122/134 |
| 2,607,193 | 8/1952 | Berggren et al. | 60/39.74 |
| 2,765,842 | 10/1956 | Lake | 158/76 |
| 2,931,430 | 4/1960 | Marshall | 158/11 |
| 2,976,919 | 3/1961 | Sanborn | 158/76 |
| 2,979,920 | 3/1961 | Sanborn | 158/76 |
| 3,076,497 | 2/1963 | Robb | 158/109 |
| 3,229,915 | 1/1966 | Yahnke | 239/430 |
| 3,258,057 | 6/1966 | Keyes et al. | 158/76 |
| 3,266,485 | 8/1966 | Girton | 126/360 R |
| 3,285,316 | 11/1966 | Gustafson et al. | 158/76 |
| 3,361,185 | 1/1968 | Anderson et al. | 158/7.5 |
| 3,364,967 | 1/1968 | Solak | 158/2 |

(List continued on next page.)

FOREIGN PATENT DOCUMENTS

| | | | |
|---|---|---|---|
| 0087519 | 6/1982 | Japan | 431/264 |
| 0180834 | 8/1986 | Japan | 431/264 |
| 1314813 | 4/1973 | United Kingdom | 431/265 |
| 1 479 144 | 7/1977 | United Kingdom . | |

*Primary Examiner*—Ira S. Lazarus
*Assistant Examiner*—Josiah C. Cocks
*Attorney, Agent, or Firm*—Michael Best & Friedrich LLP

[57] ABSTRACT

A combustion burner includes a housing secured to the top of a water heater, a gas tube in fluid communication with a source of gas and depending vertically from the housing and positioned within a heat exchange tube of the water heater. The An ignition assembly depends vertically from the top of the housing through the gas tube and into the heat exchange tube. An angled nozzle, extending from the housing, transports air from an air blower through the housing and into an annulus defined between the exterior of the annular chamber and the interior of the heat exchange tube. A deflector plate having a first and second series of slots and adjacent louvers effects the mixture of the gas and air in the interior of the heat exchange tube and enables the production of a long narrow flame within the heat exchange tube. A removable air restrictor plate positioned within the angled nozzle accelerates the air through the housing, thereby enabling the burner to achieve different thermal ratings without altering the air blower output.

48 Claims, 8 Drawing Sheets

U.S. PATENT DOCUMENTS

| | | | |
|---|---|---|---|
| 3,368,605 | 2/1968 | Reed | 158/7 |
| 3,486,835 | 12/1969 | Grobe | 431/79 |
| 3,586,242 | 6/1971 | Woolard | 239/406 |
| 3,612,737 | 10/1971 | Sharan | 431/183 |
| 3,664,804 | 5/1972 | Flournoy et al. | 431/183 |
| 3,694,135 | 9/1972 | Dancy et al. | 431/265 |
| 3,700,173 | 10/1972 | Ketchum, Jr. | 239/405 |
| 3,713,588 | 1/1973 | Sharpe | 239/400 |
| 3,733,169 | 5/1973 | Lefebvre | 431/265 |
| 3,820,944 | 6/1974 | Flournoy et al. | 431/265 |
| 3,905,752 | 9/1975 | Miller | 431/183 |
| 4,082,495 | 4/1978 | Lefebvre | 431/183 |
| 4,383,820 | 5/1983 | Camacho | 431/8 |
| 4,472,136 | 9/1984 | Lefebvre | 431/183 |
| 4,492,185 | 1/1985 | Kendall et al. | 126/350 R |
| 4,641,631 | 2/1987 | Jatana | 126/101 |
| 4,643,672 | 2/1987 | Lefebvre | 431/265 |
| 4,677,939 | 7/1987 | Henault et al. | 122/17 |
| 4,705,022 | 11/1987 | Collier | 431/353 |
| 4,766,883 | 8/1988 | Cameron et al. | 126/351 |
| 4,813,396 | 3/1989 | Sargeant et al. | 126/350 R |
| 4,884,555 | 12/1989 | Huang | 126/350 R |
| 4,952,136 | 8/1990 | Collins, Jr. et al. | 431/183 |
| 4,993,939 | 2/1991 | Fukuda et al. | 431/353 |
| 5,022,352 | 6/1991 | Osborne et al. | 122/17 |
| 5,179,914 | 1/1993 | Moore, Jr. et al. | 126/361 |
| 5,197,415 | 3/1993 | Stretch et al. | 122/13.1 |
| 5,199,867 | 4/1993 | Yap | 431/8 |
| 5,207,211 | 5/1993 | Hanning et al. | 122/33 |
| 5,267,851 | 12/1993 | Washam et al. | 431/183 |
| 5,302,115 | 4/1994 | Hagar et al. | 431/183 |
| 5,520,537 | 5/1996 | Taylor | 431/353 |
| 5,699,756 | 12/1997 | Ross et al. | 122/13.1 |

COMBUSTION BURNER FOR A WATER HEATER

RELATED APPLICATIONS

This application is a CIP of application Ser. No. 08/831,176 filed Apr. 2, 1997, and a CIP of application Ser. No. 08/602,303 filed Feb. 16, 1996, now U.S. Pat. No. 5,735,237.

BACKGROUND

The present invention relates generally to water heaters. In particular, the present invention relates to gas-fired hot water storage heaters.

In a typical storage water heater (referred to herein simply as a water heater), water is heated in a tank where it is stored in a heated condition so that, when the demand occurs, the heated water is immediately available for use. As water is drawn from the tank, cold water enters, mixing with the remaining hot water in the tank. The mixture is then brought to the preselected temperature. Storage water heaters are useful in homes and many businesses, where the demand is high during certain times of the day and low or nonexistent during the balance of the day.

Another type of water heater is an instantaneous water heater, which typically holds ten gallons or less at any one time. Instantaneous water heaters are useful in continuous demand situations, as are present in many hotels and businesses.

Hot water storage heaters may be heated from the heat of combusted gas such as natural gas, propane, or butane or by electrical resistance heating. Natural gas is cheaper than electricity, but electrical resistance heating is more efficient since all of the heat produced enters the stored water. Therefore, a highly efficient gas-heated water storage heater is the most economical to operate.

There are significant differences between commercial and residential water heaters. In fact, there is a national industry standard, ANSI Z21.10.1, for residential water heaters and a different standard, ANSI Z21.10.3, for commercial water heaters. Commercial water heaters are classified as those that are rated at more than 75,000 Btu/hr; residential water heaters are classified as those that are rated at 75,000 Btu/hr or less. Also, residential water heaters heat water to a temperature no higher than 160° F.; commercial water heaters heat to 180° F.

There are other differences as well. The recovery rates, standby heat loss rates, and efficiencies of commercial water heaters are faster, lower and higher, respectively than those of residential units. "Recovery rate" is the number of gallons of water the water heater can bring to temperature per hour and is usually a function of inlet water temperature and temperature setting. "Standby loss" is a measure of how much heat is lost over a twenty-four hour period without the addition of heat; standby loss is expressed in percents and is typically 2–3%. The efficiency of a water heater is a measure of how much heat from the combusted fuel is transferred to the water. Thus, a residential unit and a commercial unit may appear to be the same size. However, internally the commercial unit will heat water to a higher temperature and more quickly, and be made to be considerably more robust and efficient. Somewhat ironically, capacity is not a factor that distinguishes commercial from residential hot water heaters, since the capacity of both is typically 100 gallons or less.

Designing a water heater requires consideration of more than thermal efficiency. The cost of manufacturing the water heater is also important. Incremental efficiency increases will not always justify large changes in cost. Also, ease of installation and servicing are two other important factors in water heater design. Therefore, water heater designers must consider a number of factors, all too often conflicting factors, in making design decisions.

There are inevitably, then, a number of designs for water heaters. Most water heaters, however, comprise an insulated tank sized to hold a quantity of water, a source of heat, a water inlet and outlet, and a heat exchanger immersed in the water in the tank. Several structural features are generally common to water heaters or at least many water heaters, although the specific compositions, geometries and interrelationships of components of similar but not identical water heaters oftentimes result in radically different performances. For example, the heat exchanger is sometimes a tube formed into a coil through which the hot combustion gases flow, giving up much of their heat to the water surrounding the coil.

In U.S. Pat. No. 4,492,185, Kendall et al. show such a coil in a residential water heater. Their water heater includes a heat exchanger comprising a central tube that runs vertically from the top of the heater approximately halfway down, and that is then formed into a coil that continues to the bottom of the tank.

Other examples of water heaters with coils exist in the art. For example, U.S. Pat. No. 4,203,392 discloses such a design, with the additional feature of a horizontal plate placed within the interior of the tank, which defines an upper or "super heated tank" and a lower "reserve tank." In addition, U.S. Pat. Nos. 2,581,316 and 2,787,318 both advance water heaters having a spiral heating coil running the length of the tank interior.

Nonetheless, because of the quantity of hot water used in today's society, there remains a need for a high efficiency, cost-efficient, gas-fired commercial water storage heater.

In a normal combustion burner for use with water heaters, air and gas are mixed in a preselected ratio and transported at a preselected flow rate to an ignition means where the mixture is burned to produce a flame. The heat generated by combustion is transferred, by convection, through a vertically-oriented heat exchange tube to the water in the tank.

The use of these heat exchange tubes in conjunction with existing combustion burners provides inefficient results. Most existing burners produce an unfocused, "bushy" flame shape. This unfocused flame shape often contacts the interior wall of the heat exchange tube, which in turn leads to the thermal degradation of the interior lining of the heat exchange tube. Moreover, contact of the flame with condensed water, residing on the interior of the heat exchange tube, results in inadequate combustion efficiency.

Another problem not properly addressed by existing burners is the inadequate mixing of the air and gas prior to combustion. Inadequate mixing of the fluid components results in an erratic flame shape, inefficient combustion, and often results in the inability to maintain a flame, commonly referred to as a "flame out."

Still another problem common to present day combustion burners is the inability of the burner to achieve various thermal ratings without changing the air blower or altering its power consumption. The thermal rating of a burner, measured in Btus/hr, is largely a function of the air flow rate. Consequently, when it is necessary to increase the thermal rating of the burner, the air flow rate must also be increased. This increased flow rate is accomplished by increasing the voltage consumption of the air blower, thereby enabling the transportation of air at a greater flow rate. If the voltage of the air blower cannot be increased, the air blower is usually replaced with one having greater air flow capacity. Neither of these solutions is satisfactory, since both increase cost, the former in terms of operating costs and the latter in replacement costs.

Therefore, there exists a need for a combustion burner for a water heater that provides sufficient mixing of air and fuel, produces a narrow, long focused flame, and that achieves various thermal ratings without altering the characteristics of the air blower.

SUMMARY OF THE INVENTION

According to its major aspects and briefly stated, the present invention is a combustion burner for use in a gas-fired hot water storage heater. In particular, the present invention is characterized by a small, efficient burner for use with a heat exchange conduit or tube. The heat exchange tube is disposed within a water chamber defined by a holding tank, and includes a full length central conduit or tube and a coil conduit or tube having a smaller diameter than that of the central tube and encircling the central tube in large-diameter coils. A joining conduit or tube communicates between the central tube and the coil tube.

A high powered air blower cooperates with the burner and heat exchange tube to provide oxygen for combustion of the gas, and pressure to drive the hot combustion gases through the heat exchange tube with at least enough force to avoid the need for a chimney. A water heater made according to the present invention operates with high efficiency, at 93% or higher, and is relatively inexpensive to manufacture compared to other water heaters that are less efficient.

Prior art water heaters typically include a relatively small diameter central tube connected to a large combustion chamber wherein combustion takes place. In these prior art water heaters, the hot combustion gases are funneled from the combustion chamber into the small diameter central tube.

The present invention, however, provides a relatively large diameter central tube having the small but efficient burner mounted at least partially therein. This configuration eliminates the need for a separate combustion chamber and the costs associated with manufacturing and installing the separate combustion chamber. The burner focuses the flame within the central tube, thereby eliminating damage to the heat exchange tube from impinging combustion flames.

The central tube runs substantially to the bottom of the water tank so as to accommodate the length of the burner flame, to increase residency time of hot gas in the heat exchange tube, and to increase the overall surface area of the heat exchange tube. It is advantageous to have the coil tube run downhill to conduct condensate from the gradually cooling combustion gases out of the system. Therefore, the joining tube runs directly upward from the bottom of the central tube to the top of the coil tube, just below the mid-point of the tank. The large diameter of the coils assures that the exhaust gas flow is not unduly constricted and raises residency time of the combustion gases within the coil tube. The residency time of the combusted gas and the surface area of the coils combine to achieve a high degree of heat exchange.

Another feature of the present invention is the combustion burner, which includes a housing secured to the top of the water heater. The interior of the housing is formed with an inner wall or gas tube depending vertically therefrom, which gas tube is placed a preselected distance within the central tube of the heat exchange tube of the water heater. The interior of the gas tube defines an inner space in fluid communication with a source of gas. An outer, preferably annular space is defined between the outside of the gas tube and the inside an outer wall that may be a part of the central tube.

Extending from the housing at approximately a 45° angle is an orifice or nozzle formed in the housing to enable fluid communication between the blower and the annular space. Positioned within the orifice is an air restrictor plate, the significance of which is explained below.

Affixed to the end of the gas tube and positioned horizontally within the central tube is a deflector plate. The deflector plate is formed with a first series of inner slots arranged in a circular pattern and in fluid communication between the inner space and a combustion portion or combustion chamber of the heat exchange tube. A second series of outer slots, formed in the deflector plate and also arranged in a circular pattern, surrounds the first series and is in fluid communication between the annular space and the combustion chamber. Thus, gas flows through the first slots and air flows through the second slots.

Adjacent to each slot is a louver that depends from the deflector plate at a preselected angle. The slots and accompanying louvers are constructed to substantially uniformly mix the air and fuel by swirling and directing the mixture toward the center of the combustion chamber. The perimeter of the deflector plate is angled in an upward direction toward the top of the water heater to better channel the air toward the second series of slots.

An ignition assembly depends vertically from the interior of the housing through the gas tube and extends into the combustion chamber through an aperture formed substantially in the center of the deflector plate. A flame sensor or other means for sensing the presence of a flame also depends vertically from the interior of the housing, through the annular space, and extends into the combustion chamber through an aperture in the deflector plate. The flame sensor shuts off the flow of gas when a flame is not present within the combustion chamber In operation, air from the blower is forwarded to the angled nozzle and subsequently passes through the air restrictor plate. The air restrictor plate accelerates the air downward into the annular space and subsequently through the second series of slots formed in the deflector plate. Gas from a gas source is transported through the gas tube and expelled therefrom via the first series of slots in the deflector plate. The louvers serve to swirl and thus substantially uniformly mix the air and gas while directing the mixture toward the centrally positioned ignition assembly. The ignition assembly effects the combustion of the mixture in the combustion chamber.

The inner diameter of the restrictor plate is chosen to accelerate the air to a particular flow rate to enable the burner to achieve a particular thermal rating (measured in Btu/hr). Consequently, by changing the inner diameter of the restrictor plate, the thermal rating of the burner may be altered without having to replace the blower or increase its voltage consumption. Moreover, the increased air flow rate results in the production of a long, narrow, focused flame shape that avoids contact with the interior wall of the central tube, and enables the burner to be placed into the central tube.

Another feature of the present invention is the angled nozzle which introduces the air into the annulus. It has been found that placing the nozzle at approximately a 45° angle provides an even distribution of air about the surface of the deflector plate. When the air is expelled through the slots, the resulting flame is uniform and controlled, thus avoiding the combustion inefficiencies caused by both "oxygen rich" and "oxygen lean" combustion conditions.

Yet another feature of the present invention is the circular orientation of the first and second series of slots and the louvers depending from the deflector plate at specified angles. The orientation of the slots and the louvers results in the swirling of gas in a direction counter to that assumed by the air, which in turn thoroughly and uniformly mixes the gas and air. Moreover, because the air is directed to the center of the heat exchange tube, less of the air and gas contact the interior wall of the heat exchange tube. Consequently, combustion efficiency is maximized since there is less condensation of combustible fluids on the interior of the heat exchange tube. While in the preferred embodiment gas flows through the inner space and the inner slots, and air flows through the outer space and the outer slots, in an alternative embodiment the gas may flow through the outer space and the outer slots while the air flows through the inner space and inner slots.

The upwardly angled perimeter of the deflector plate is still another feature of the present invention. The angled perimeter serves to urge air toward the second series of slots formed in the deflector plate and thereby increases combustion efficiency.

Other features and their advantages will become apparent to those skilled in the art from a careful reading of the detailed description, claims, and drawings.

DETAILED DESCRIPTION

Figure 1:
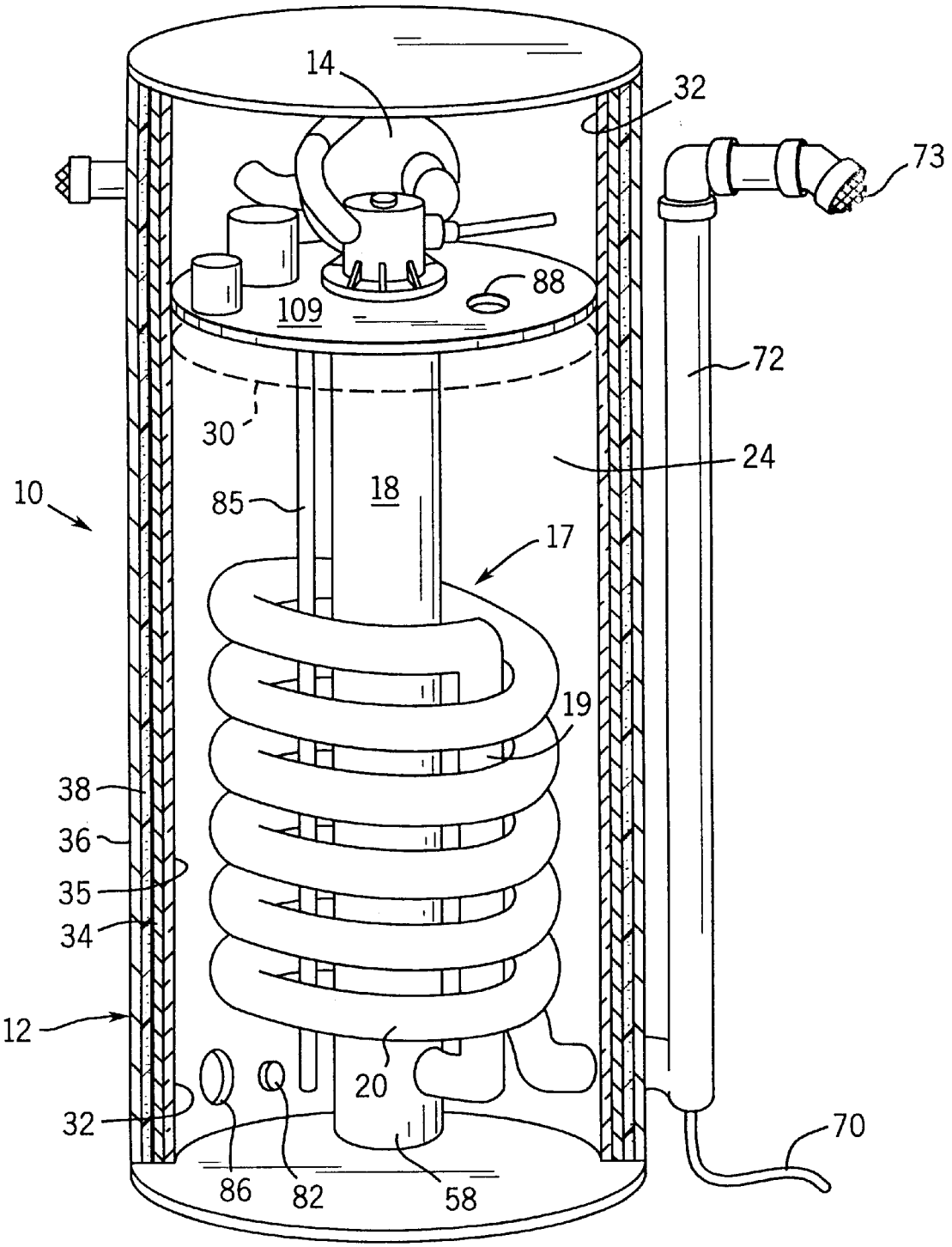
FIG. 1 is a partially cut away perspective view of a commercial water heater embodying the present invention.
Figure 2:
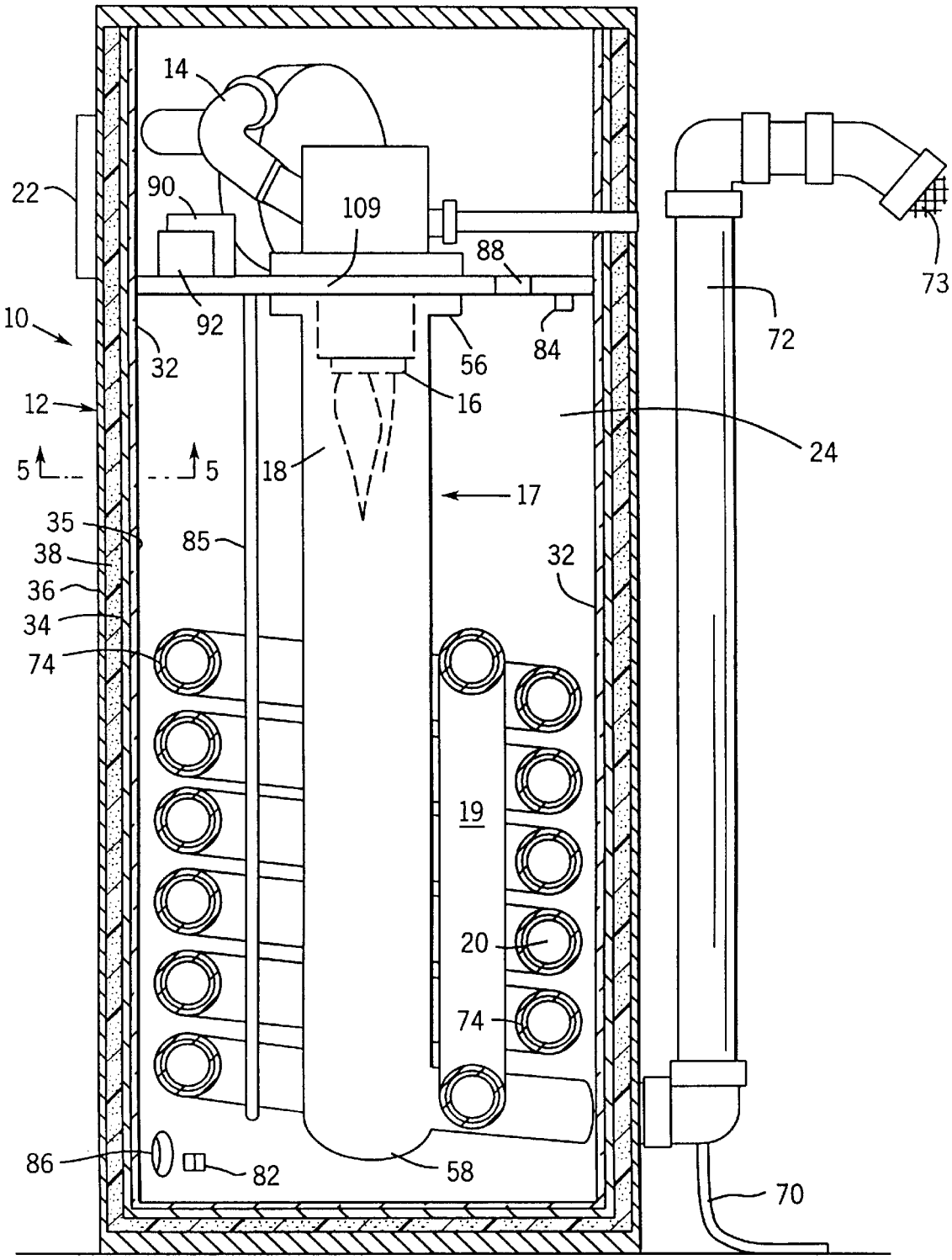
FIG. 2 is a cross sectional side view of the water heater.
Figure 3:
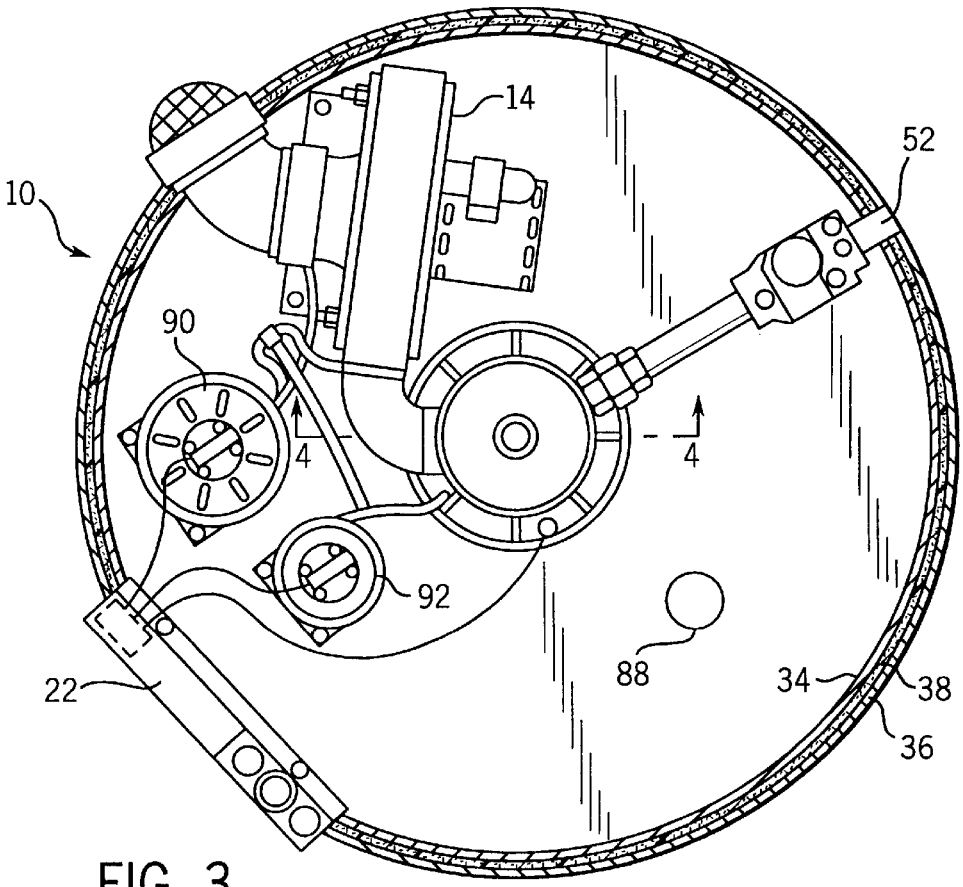
FIG. 3 is a cross sectional top view of the water heater.
Figure 5:
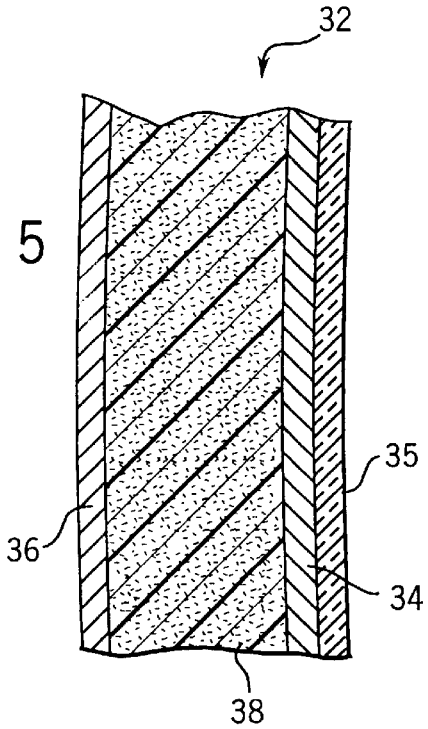
FIG. 5 is a cross sectional side view of the tank wall.
Figure 4:
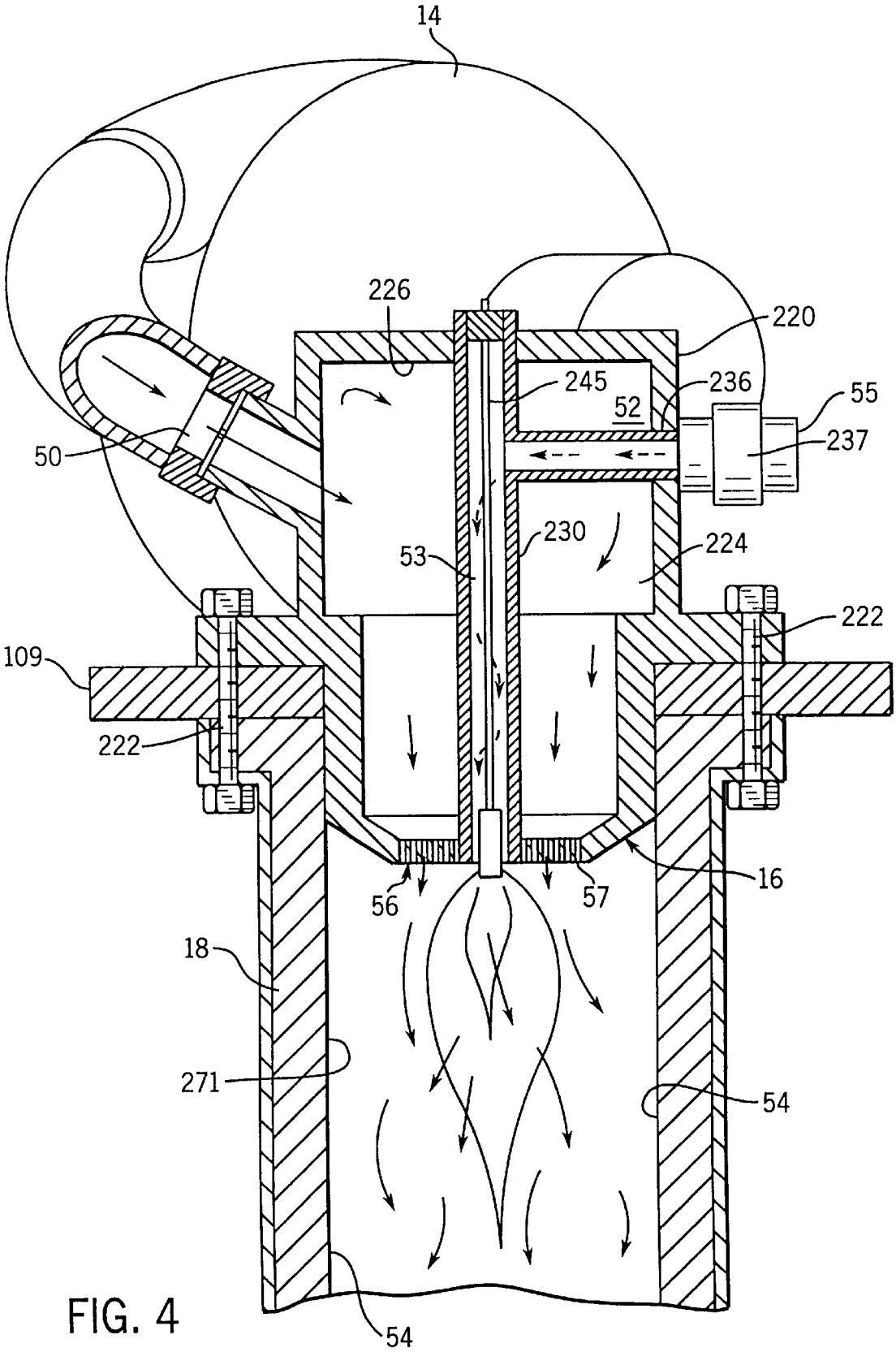
FIG. 4 is a cross sectional side view of the blower and burner taken along line 4—4 of FIG. 3.

Referring now to the embodiment of the invention illustrated in FIGS. 1–5, there is shown a water heater generally designated by reference number 10. The major components of water heater 10 are a tank 12, a blower 14, a burner 16, and a heat exchange conduit or tube 17. The heat exchange tube includes a central conduit or tube 18, a joining tube or conduit 19, and a coil conduit or tube 20. Another major component of the water heater 10 is a control system 22.

Taking each of these major components in turn, holding tank 12 is preferably a right cylinder defining a water chamber 24 dimensioned to hold a quantity of water 30 and having an insulated wall 32. Wall 32 has a sandwich-type construction composed of an inner layer 34, an outer layer 36 and a layer of insulation 38 therebetween. Inner layer 34 is preferably glass coated steel, with glass coating 35 serving to protect inner layer 34 from the corrosive effects of water 30. Outer layer 36 is preferably painted steel. Insulation 38 is preferably polyurethane foamed in place after inner and outer layers 34, 36, are assembled.

Blower 14 is mounted to the top of tank 12 and pumps air through a throat or nozzle 50 into a first chamber 52. Throat 50 serves to accelerate air into first chamber 52. Positioned within first chamber 52 is a second chamber 53 which is in fluid communication with a gas line 55. Air in first chamber 52 and gas in second chamber 53 travel through holes 57 in plate 56 where the air and natural gas mix and are subsequently combusted. Blower 14 must provide sufficient air for complete combustion and enough air pressure to drive the combustion gases from water heater 10. Preferably, blower 14 will pump air at almost 4400 feet per minute and deliver a volume of approximately 150 cubic feet per minute. Throat 50 accelerates the air flow still further, preferably doubling its speed before the air mixes with the gas.

Burner 16 is a highly efficient, small diameter burner capable of burning a gas/air mixture to produce 240,000 Btus/hr. Burner 16 must fit within central tube 18, which is preferably five inches in diameter. It must also produce a small diameter flame so that the flame does not impinge on the wall 54 of central tube 18.

The flame will be long, and therefore central tube 18 must extend substantially the full length of the tank 12 so that the flame does not impinge on wall 54. Central tube 18 has hot combustion gases running from burner 16 at a proximal end 56 to a distal end 58. A portion of the heat from the hot gas will be conducted through wall 54 and into water 30. In coil tube 20, a high percentage of the remainder of the heat will be exchanged into water 30.

Coil tube 20 has a diameter approximately one-half that of central tube 18 so the flow of hot gases is somewhat restricted. Coil tube 20 coils around central tube 18 in a series of large diameter, small pitch coils, generously spaced so that the residency time of the hot gas is long enough to permit nearly complete heat exchange. Because central tube 18 runs to the bottom of tank 12, and it is desirable to have coil tube 20 run downhill, joining tube 19 is used to conduct the combustion gases from the bottom of central tube 18 to the top of coil tube 20.

As the hot gases cool, moisture in the gases condenses and must be removed from coil tube 20 to prevent corrosion of the coil tube wall. The temperature of the gases is too high for condensation in central tube 18 and joining tube 19, but toward the end of coil tube 20, condensation occurs. At the very end of coil tube 20 is a drain line 70 to remove condensates to an external drain (not shown). Gas exiting coil tube 20 is forwarded through an exhaust pipe 72, external to tank 12, and is exhausted through opening 73 into the atmosphere.

Central tube 18, joining tube 19, and coil tube 20 are made of metal. The outside of wall 54 of central tube 18 is glass coated to resist the corrosive effects of the water 30. The inside and outside of the walls of joining tube 19 and coil tube 20 are also coated with glass to prevent corrosion caused by condensate in coil tube 20 and water 30 in tank 12, respectively.

Control system 22 includes two electronic sensors 82 and 84 for controlling blower 14 and burner 16. Sensor 82 is an inlet thermostat; sensor 84 is an outlet thermostat. Sensor 82 is triggered and turns on burner 16 when cold water enters inlet 86. Sensor 84 is a high temperature sensor and turns off burner 16 when the temperature of water 30 exiting through outlet 88 reaches a preselected setpoint. The influx of cold water, the removal of water 30 from the tank 12, and the volume of water 30 as a function of height make calculation of the water temperature in tank 12 difficult. However, by weighing the output signals of sensors 82 and 84, an approximate overall water temperature can be obtained for water 30 within tank 12. It has been determined that the following calculation provides an estimate for the temperature of water 30 within tank 12:

T=((temp (F°) measured at sensor 84×6)+(temp (F°) measured at sensor 82))/7

Control system 22 also includes differential pressure switches 90 and 92. Switch 90 senses a differential pressure across blower 14. When a certain pressure across blower 14 is sensed by switch 90, an electrical signal is sent to control system 22 signifying the movement of air. Upon receipt of this signal, control system 22 will initiate operation of burner 16. Switch 92 measures a back pressure in burner 16. If burner 16 becomes blocked, switch 92 opens and control system 22 will shut down water heater 10.

Within tank 12 is an anode 85. Anode 85 is electrically insulated from tank 12, which serves as the cathode. In operation, anode 85 is held at a slight positive electrical potential with respect to tank 12. Glass coating 35 on the inside of inner layer 34 inevitably will have fine holes where the surface of inner layer 34 will be exposed to water 30. By applying the slight potential difference to anode 85, the direction of ionic movement will be from anode 85 to the cathode through the water, resulting in a slow degradation of anode 85. This direction of movement prevents inner layer 34 from degrading, however. A suitable anode 85 can be made of aluminum or magnesium.

The precise geometry of a water heater according to the present invention will vary depending on a number of factors. However, an example of a water heater design, for a commercial, 180° F., water heater with a storage capacity of 100 gallons is a 24 inch diameter tank 12 having zero clearance on all sides and a 1½ inch clearance on top for maintenance, and a burner 16 rated at 240,000 Btu/hr and operating in a five inch diameter central tube 18 having a 0.111 inch thick wall. Blower 14 supplies air at a flow rate of almost 4400 feet/minute for oxygen supply and pressure to drive the gas through fifty feet of exhaust pipe, and produces a flame 14 to 23 inches in length, most or all of which extends below the level of the water 30 in the water chamber 24 (see FIG. 1). The wall 74 of coil tube 20 is 0.060 inches thick. Sensors 82 and 84 are weighted 1:6 in determining water temperature. Such a heater will have a standby loss rate of 1% and an average efficiency of 93%.

Figure 6:
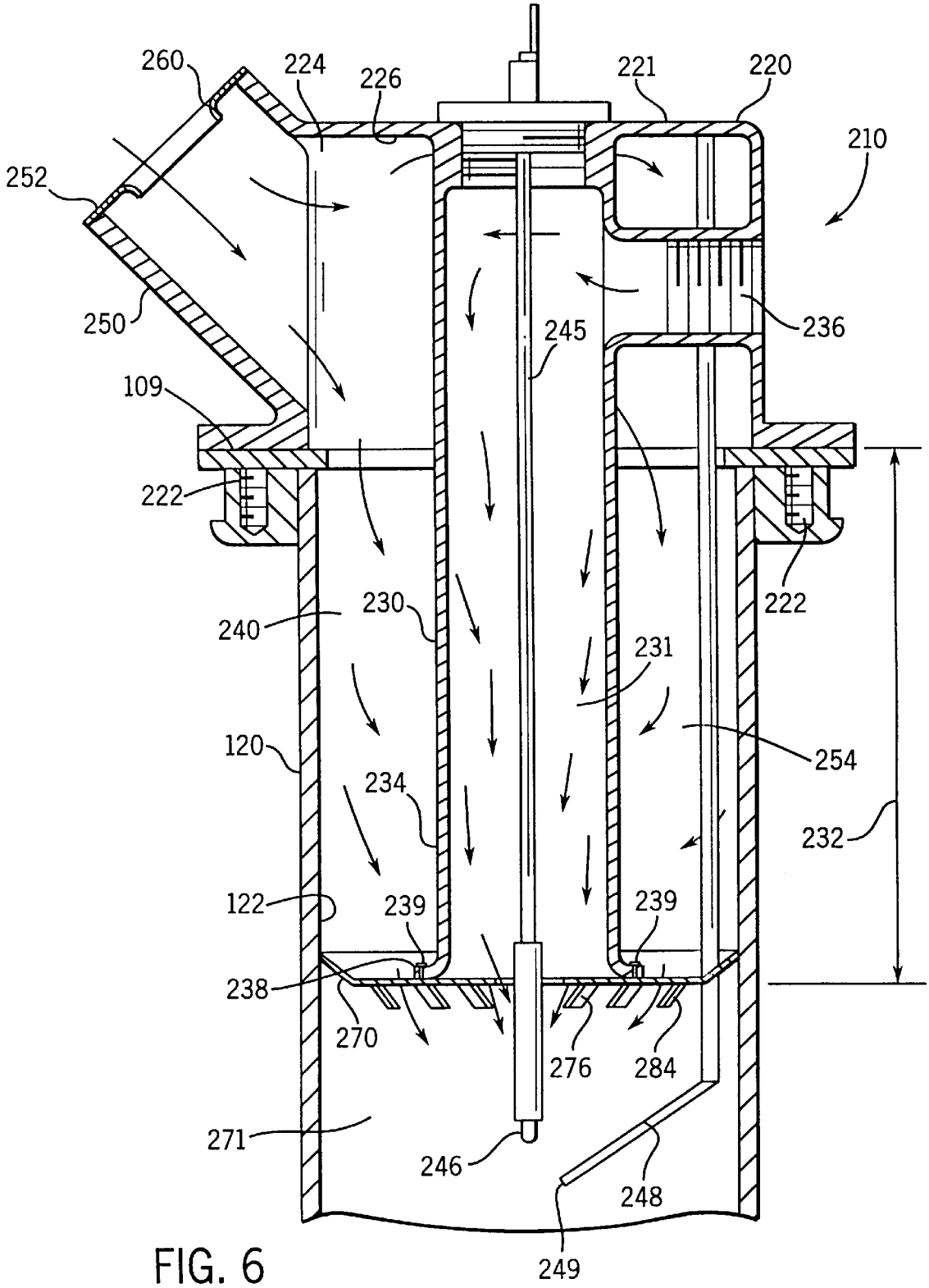
FIG. 6 is a cross-sectional side view of the combustion burner in the preferred embodiment of the invention.
Figure 7:
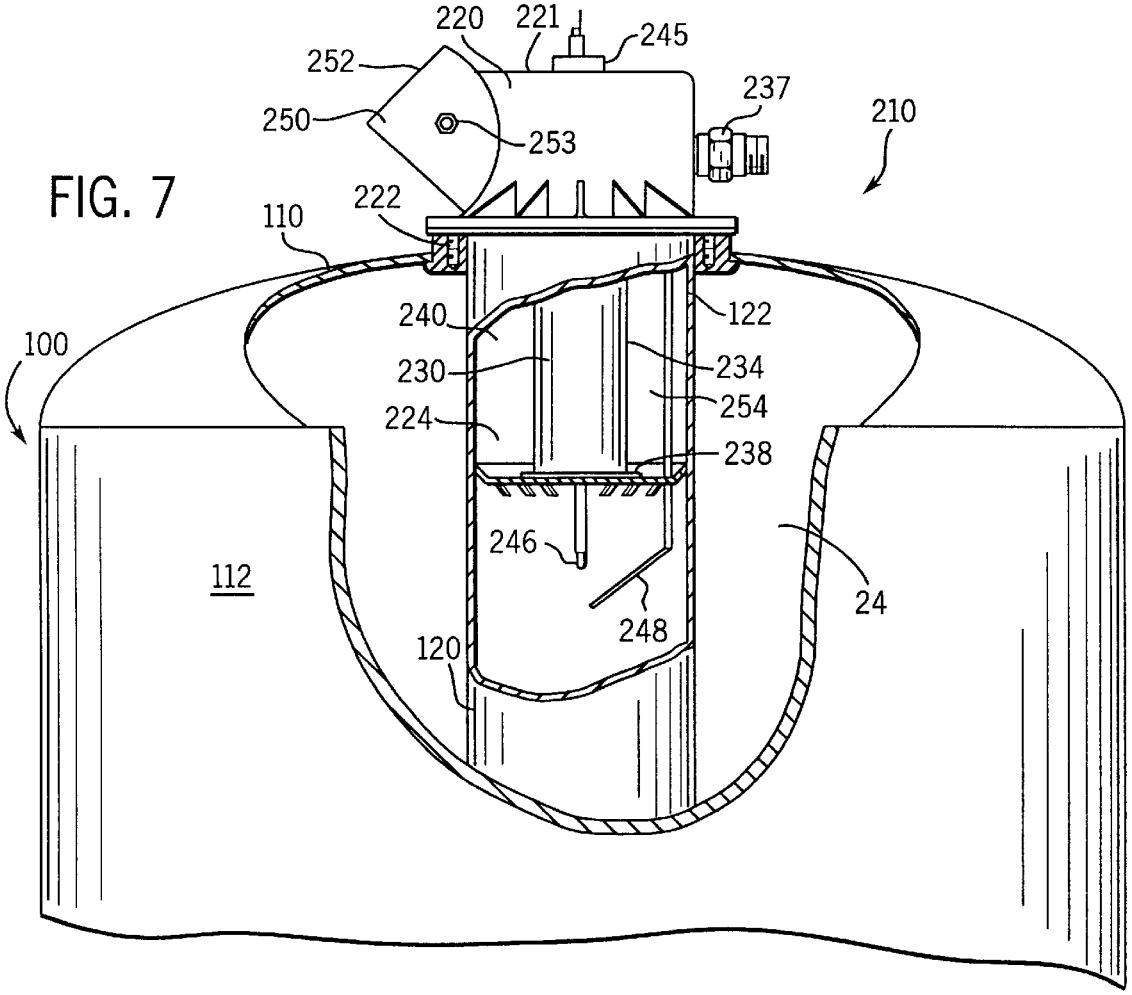
FIG. 7 is a cutaway, partial cross-sectional view of a water heater and the combustion burner of FIG. 6.

A preferred combustion burner, which provides complete combustion and is capable of producing a long narrow flame, is illustrated in FIGS. 6–13. Referring now to FIGS. 6–7, there is shown a detailed cross-sectional view and a partial cutaway view of a burner generally designated by reference numeral 210. Burner 210 comprises a housing 220 secured to a mounting surface 109 on a top portion 110 of a holding tank 112 of water heater 100 by a plurality of bolts 222. Holding tank 112 defines a water chamber 24 for holding water 30 (see FIG. 1). It will be recognized by those with ordinary skill in the art that other securing means may be substituted for bolts 222 without departing from the spirit and scope of the invention. While the burner 210 is shown on the tank 112 in FIG. 7, it can also be used in the water heater 10 of FIGS. 1–5.

As seen in FIG. 6, interior 224 of housing 220 is formed with a centrally positioned inner wall, inner tube, gas conduit, or gas tube 230 that depends vertically from top 226 of interior 224 and extends a preselected distance into outer wall, heat exchange conduit, or heat exchange tube 120 defining a heat exchange passage. Gas tube 230 defines an inner space 231. Preferably, the distance to which gas tube 230 extends within heat exchange tube 120, as denoted by reference numeral 232 in FIG. 6, is approximately 5.75 inches.

In FIG. 6, a horizontally positioned deflector plate 270 is secured by bolts 239 to end 238 of gas tube 230. The portion of heat exchange tube 120 adjacent the side of deflector plate 270 facing away from or below gas tube 230 defines a combustion portion or combustion chamber 271 of heat exchange tube 120. The combustion chamber 271 is disposed within the water chamber 24 (see FIG. 1). Inner space 231 is in fluid communication between gas inlet tube 236 and combustion chamber 271. An orifice holder 237 is threaded within gas inlet tube 236 and permits the removable attachment of a gas source (not shown).

Housing 220 has extending therefrom an angled nozzle 250. Preferably, nozzle 250 is at approximately a 45° angle, the significance of which will be explained in detail below. As seen in FIG. 6, removably attached to end 252 of nozzle 250 is an air restrictor plate 260. Nozzle 250 is attached to a source of air or an air blower 14 (see FIGS. 1–3) which transports a flow of air through nozzle 250 and into annular space, annulus, or outer space 240, which is defined between gas tube 230 and heat exchange tube 120. Formed in nozzle 250 is a barb hose 253 in fluid communication with the interior of nozzle 250. Barb hose 253 allows the attachment of a pressure sensor (not shown) to ensure that the air entering annulus 240 is at the correct pressure.

Threaded within top 221 of housing 220 is an ignition assembly 245. Ignition assembly 245 is positioned within the interior of gas tube 230 and extends through aperture 272 of deflector plate 270 into combustion chamber 271. The ignition assembly 245 is adapted to ignite the combustible mixture. Preferably, end 246 of ignition assembly 245 is approximately 0.75 to 0.875 inches from deflector plate 270. A flame sensor 248, removably threaded within top 221 of housing 220, is positioned within annulus 240 and extends through aperture 273 of deflector plate 270 into combustion chamber 271. Tip 249 of flame sensor 248 is preferably placed approximately 2.5 inches below end 246 of ignition assembly 245. Flame sensor 248 detects the presence of flame within combustion chamber 271, and will discontinue the flow of gas if flame is not detected.

Figure 8:
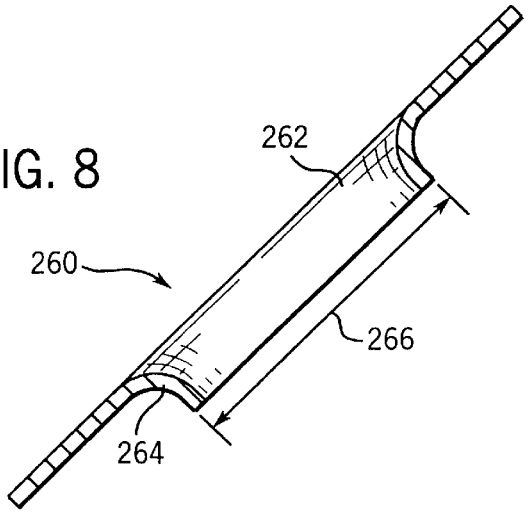
FIG. 8 is a cross-sectional view of an air restrictor for the combustion burner.

Referring now to FIG. 8, there is shown a cross-sectional view of air restrictor plate 260. Restrictor plate 260 is formed with a centrally positioned aperture 262 having an inner diameter 266 and a flared perimeter 264. As illustrated in FIG. 6, restrictor plate 260 is secured to end 252 of nozzle 250 so that a portion of flared perimeter 264 is positioned within nozzle 250. Air restrictor 260 serves to accelerate air, forwarded by the blower 14, into annulus 240. Inner diameter 266 is chosen in accordance with the thermal rating which is to be achieved by burner 210. For a rating of 150,000 Btu/hr, inner diameter 266 is approximately 0.875 inches; to achieve a rating of 199,900 Btu/hr, inner diameter 266 is approximately 1.031 inches, while a 240,000 Btu/hr rating requires inner diameter 266 to be approximately 1.196 inches. These ratings, and corresponding diameters, are based upon the use of an air blower having a rating of 82 CFM at 120 volts. It is recognized that the precise diameter of inner diameter 266 may vary slightly, depending upon the type and capacity of air blower 14, and that the achievement of a particular thermal rating may require a slight degree of experimentation commonly undertaken by those with ordinary skill in the art.

Figure 9:
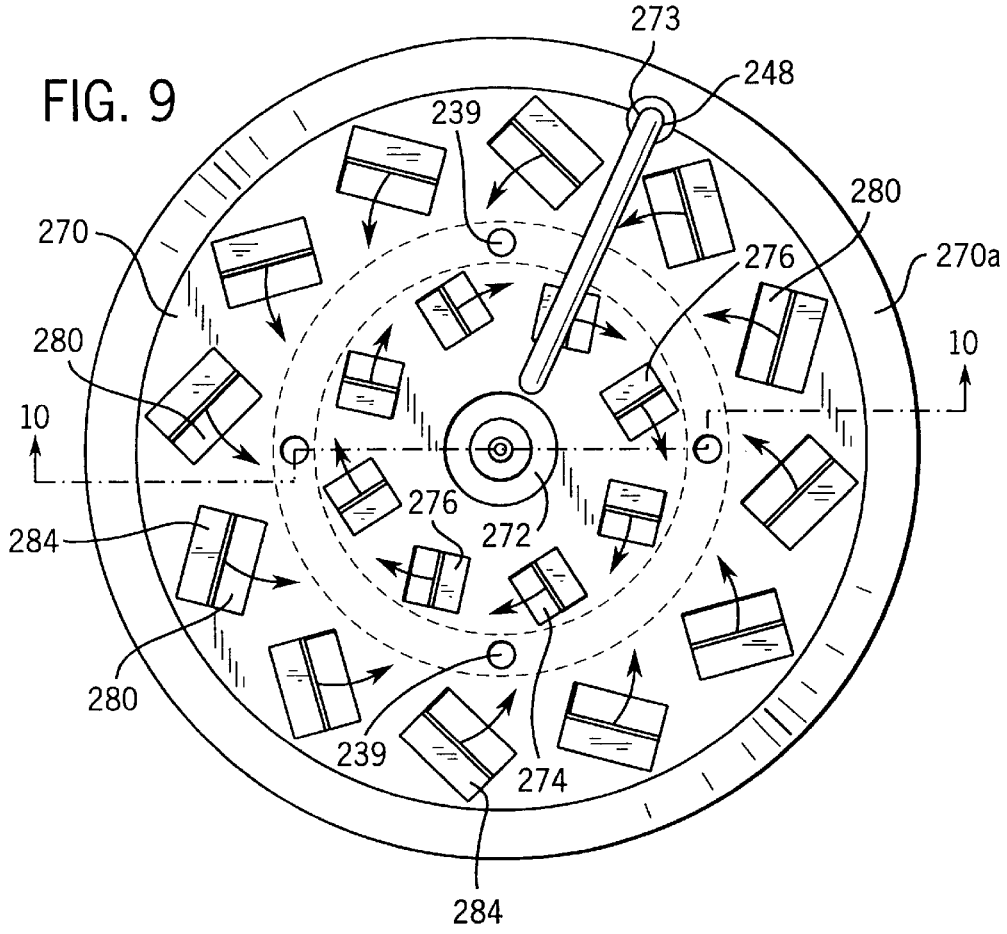
FIG. 9 is a bottom view of a deflector plate for the combustion burner.
Figure 10:
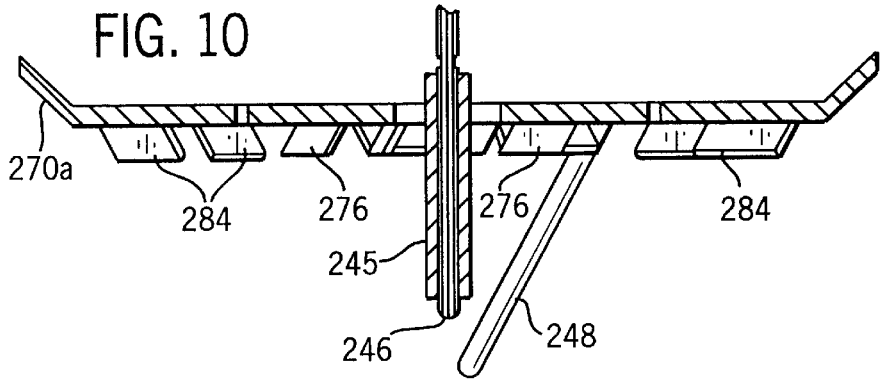
FIG. 10 is a side cross-sectional view of the deflector plate taken along line 10—10 of FIG. 9.
Figure 13:
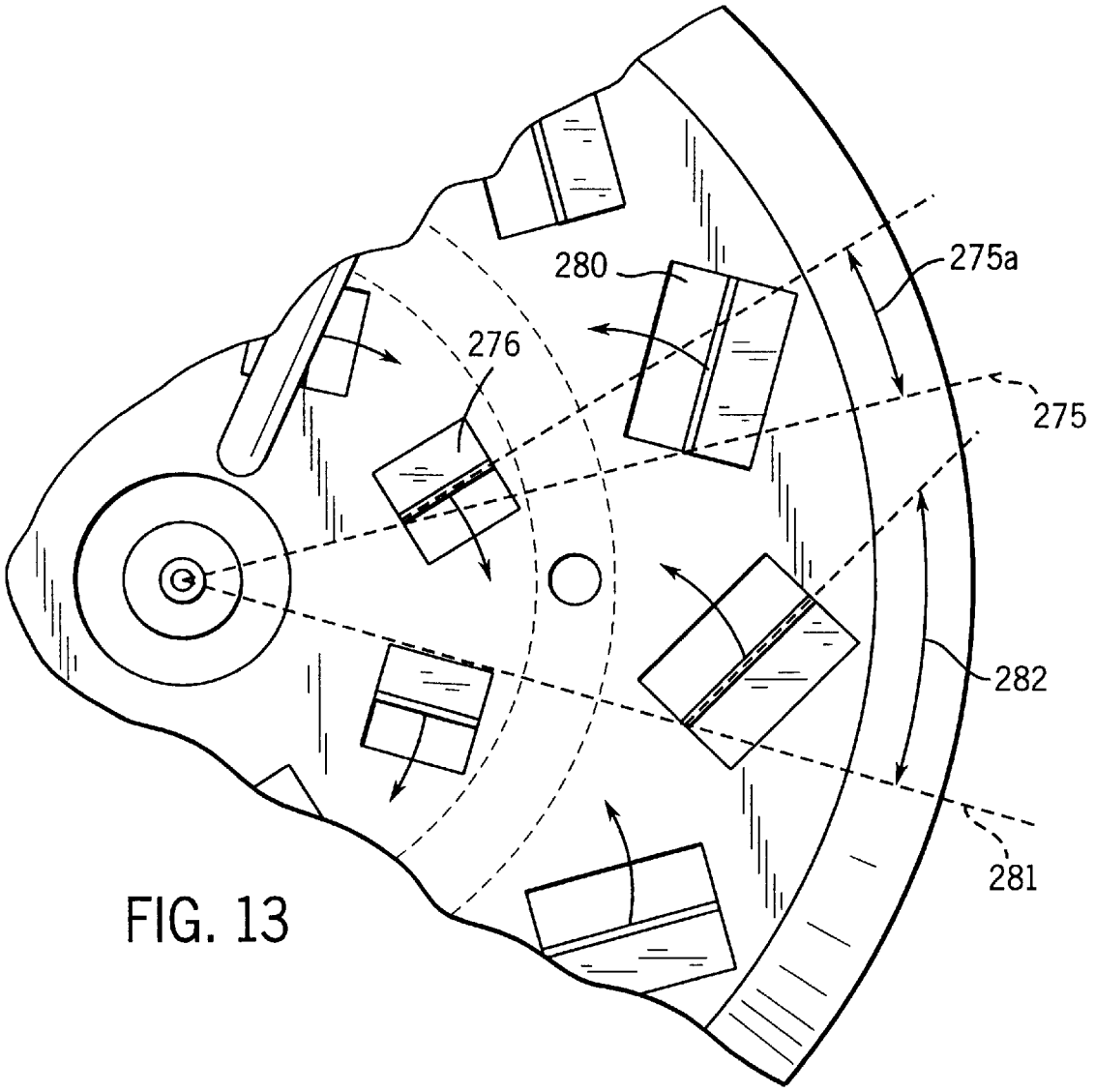
FIG. 13 is an enlarged portion of FIG. 9.

Referring now to FIGS. 9 and 10, there is shown a bottom view and a cross-sectional side view, respectively, of deflector plate 270. Deflector plate 270 is formed with a first or inner series of slots or openings or apertures 274. Slots 274 are arranged in a circular pattern and are in fluid communication with gas tube 230, thereby allowing gas to be expelled from gas tube 230 and into combustion chamber 271. Preferably there are eight slots 274, each of which has a length of 0.33 inches and a width of 0.33 inches. As seen in FIG. 13, slots 274 are angled with respect to a radial line 275 at an angle 275*a* equal to about 17° in the preferred embodiment.

Figure 12:
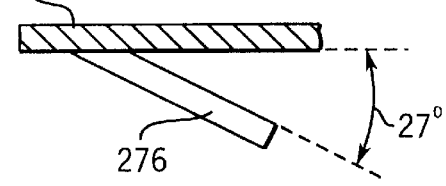
FIG. 12 is a cross-sectional side view of a louver depending from the deflector plate.

Adjacent to each slot 274 is a louver 276, depending from deflector plate 270 into combustion chamber 271. Louvers 276 depend from deflector plate 270 at approximately a 27° angle (as shown in FIG. 12) and direct gas from gas tube 230 in a first direction generally away from ignition assembly 245.

Surrounding first series of slots 274 is a second or outer series of slots or openings or apertures 280. Slots 280 are also arranged in a circular pattern and are in fluid communication with annulus 240, enabling air from annulus 240 to be expelled into combustion chamber 271. Preferably, there are twelve slots 280, each of which has a length of 0.440 inches and a width of 0.50 inches. As seen in FIG. 13, slots 280 are angled with respect to a radial line 281 at an angle 282 equal to about 60° in the preferred embodiment.

Figure 11:
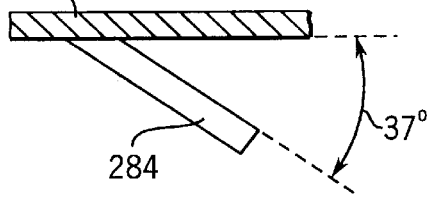
FIG. 11 is a cross-sectional side view of a louver depending from the deflector plate.

Adjacent to each slot 280 is a louver 284 which depends from deflector plate 270 into combustion chamber 271 at approximately a 37° angle (as shown in FIG. 11) and directs air in a second direction generally toward ignition assembly 45. The second direction is substantially opposite the first direction, such that the deflector plate 270 causes the flow of air and the flow of gas to swirl and mix within the combustion chamber 271 to form a substantially uniform combustible mixture of gas and air. Deflector plate 270 is also formed with upwardly angled perimeter 270*a,* which serves to channel air toward second series of slots 280 and away from interior wall 122 of heat exchange tube 120.

In operation, burner 210 is activated by first forwarding air from the air blower 14 into angled nozzle 250, at which time the air is accelerated by air restrictor 260 into annulus 240. It has been found that angling nozzle 250 at approximately a 45° angle enables an even distribution of air to impact deflector plate 270, and consequently, inefficient combustion due to "oxygen rich" and "oxygen lean" conditions is avoided. Once a sufficient air flow is established within annulus 240, the gas source is activated, forwarding gas into gas tube 230.

The substantially uniform mixture provided by deflector plate 270 in the combustion chamber 271 is then ignited by ignition assembly 245 to produce a long, narrow flame between approximately 14 and 23 inches in length, depending upon the actual air-to-fuel ratio. The production of a long, narrow flame avoids contact with interior wall 122 of heat exchange tube 120 and thereby reduces the thermal degradation of heat exchange tube 120.

It is within the scope of the invention to switch the air supply and gas supply. That is to say, with some modifications, air may be fed though the inner tube 230, while gas is fed through the annulus 240, and the air and gas will still be uniformly mixed in the combustion chamber 271 by the deflector plate 270 as described above.

It will be apparent to those skilled in the art that many other modifications and substitutions may be made to the preferred embodiments described above without departing from the spirit and scope of the invention, which is defined by the appended claims.

We claim:

1. A water heater comprising:

a holding tank defining a water chamber;

a heat exchange conduit extending through the water chamber and having therein a combustion chamber, the combustion chamber being at least partially disposed within the water chamber;

an inner wall at least partially defining an inner space, the inner space being in fluid communication with the combustion chamber;

an outer space at least partially surrounding the inner wall, the outer space being in fluid communication with the combustion chamber;

one of the inner space and the outer space being communicable with a source of air and the other of the inner space and the outer space being communicable with a source of gas so that a flow of gas mixes with a flow of air in the combustion chamber to create a combustible mixture;

a deflector plate positioned between the inner space and the combustion chamber and between the outer space and the combustion chamber, the deflector plate including a first series of apertures communicating with the inner space, and a second series of apertures communicating with the outer space, a first series of louvers each positioned adjacent a respective one of the first series of apertures, the first series of louvers being adapted to direct one of the flow of air and the flow of gas in a first direction, and a second series of louvers each positioned adjacent a respective one of the second series of apertures, the second series of louvers being adapted to direct the other of the flow of air and the flow of gas in a second direction that is substantially opposite the first direction to cause the combustible mixture to be a substantially uniform mixture of air and gas prior to ignition of the combustible mixture; and an ignition assembly partially disposed within the combustion chamber, and adapted to ignite the combustible mixture.

2. The water heater of claim 1, wherein the inner wall extends into the heat exchange conduit.

3. The water heater of claim 1, further comprising an outer wall at least partially surrounding the outer space, whereby the outer space is at least partially defined between the inner wall and the outer wall.

4. The water heater of claim 3, wherein the outer wall includes a portion of the heat exchange conduit.

5. The water heater of claim 1, wherein the deflector plate causes the flow of gas and the flow of air to swirl within the combustion chamber.

6. The water heater of claim 1, wherein each of the first series of louvers extends into the combustion chamber at approximately a 27° angle with respect to the deflector plate, and wherein each of the second series of louvers extends into the combustion chamber at approximately a 37° angle with respect to the deflector plate.

7. The water heater of claim 1, wherein the first series of louvers is adapted to direct the flow of gas in the first direction, and the second series of louvers is adapted to direct the flow of air in the second direction.

8. The water heater of claim 7, wherein the deflector plate includes an upwardly angled perimeter that directs the flow of air toward the second series of apertures.

9. The water heater of claim 7, wherein the inner wall includes a cylindrical tube, the heat exchange conduit is substantially cylindrical and includes the outer wall, and wherein the outer space is defined between the outer wall and the inner wall.

10. The water heater of claim 9, wherein the inner wall and the outer wall are concentric, and the outer space is an annular space.

11. The water heater of claim 9, wherein the deflector plate is substantially circular in shape, and includes an upwardly angled perimeter that directs the flow of air toward the second series of apertures.

12. The water heater of claim 11, wherein the first series of apertures is arranged in a circular pattern and the second series of slots is arranged in a circular pattern.

13. The water heater of claim 12, wherein the first series of apertures includes a first series of slots, each of the first series of slots being angled with respect to a radial line of the deflector plate, and wherein the second series of apertures includes a second series of slots, each of the second series of slots being angled with respect to a radial line of the deflector plate.

14. The water heater of claim 13, wherein each of the first series of slots is angled at about 17° with respect to a radial line and each of the second series of slots is angled at about 60° with respect to a radial line.

15. The water heater of claim 7, wherein the first series of louvers and the second series of louvers direct the combustible mixture substantially to the center of the combustion chamber, and wherein ignition of the substantially uniform mixture creates a flame that does not contact the heat exchange conduit.

16. The water heater of claim 1, wherein the deflector plate defines an aperture, and a portion of the ignition assembly passes through the aperture.

17. The water heater of claim 16, wherein a portion of the ignition assembly is disposed within the inner space.

18. The water heater of claim 1 further comprising a nozzle in fluid communication between the source of air and the one of the inner space and the outer space, the nozzle extending upwardly away from the water heater at a selected angle.

19. The water heater of claim 18, wherein the selected angle is approximately 45°.

20. The water heater of claim 18, wherein the source of air is a blower that provides the flow of air at a velocity sufficient to drive combustion gases from combustion of the combustible mixture through the heat exchange conduit and then through an approximately fifty-foot vertical stand of pipe.

21. The water heater of claim 20, wherein the velocity at which the blower provides the flow of air at almost 4400 feet per minute.

22. The water heater of claim 20, wherein the blower provides air at a volume of at least approximately 150 cubic feet per minute.

23. The water heater of claim 20, further comprising means positioned in the nozzle for accelerating air from the air blower into the one of the outer space and the inner space.

24. The water heater of claim 18, further comprising an air restrictor plate partially disposed in the nozzle for controlling the amount of air that passes into the one of the inner and the outer spaces, thereby selectively controlling the amount of air in the combustible mixture.

25. The water heater of claim 24, wherein the air restrictor plate includes a portion of reduced diameter that causes the flow of air to accelerate as the flow of air enters the one of the inner space and the outer space.

26. The water heater of claim 1, wherein the combustion chamber is positioned near the top of the water heater, and wherein the air flow and the gas flow are directed downward.

27. The water heater of claim 1, further comprising means for sensing the presence of a flame, the means for sensing being partially disposed within the combustion chamber.

28. The water heater of claim 27, wherein the means for sensing is operatively interconnected with the source of gas and is adapted to shut off the flow of gas when a flame is not present within the combustion chamber.

29. The water heater of claim 1, wherein the heat exchange conduit includes a central conduit and a coil conduit in fluid communication with the central conduit and encircling the central conduit, the central conduit and the coil conduit being substantially disposed within the holding tank and being adapted to allow combustion gases to pass therethrough.

30. The water heater of claim 29, wherein the central conduit is a substantially cylindrical central tube having an inner diameter, the coil conduit is a substantially cylindrical coil tube having an inner diameter, and the coil tube inner diameter is smaller than the central tube inner diameter.

31. The water heater of claim 30, wherein the central tube diameter does not exceed approximately 5 inches.

32. The water heater of claim 30, wherein the coil tube diameter is approximately half the central tube diameter.

33. The water heater of claim 29, wherein the holding tank includes a top and a bottom, and wherein the central conduit extends substantially between the top and the bottom of the holding tank, and wherein the coil conduit extends between approximately the middle of the holding tank to the bottom of the holding tank.

34. The water heater of claim 33, wherein the heat exchange conduit includes a joining conduit in fluid communication between an end of the central conduit adjacent the bottom of the holding tank and an end of the coil conduit positioned approximately in the middle of the holding tank.

35. The water heater of claim 29, wherein the coil conduit is dimensioned so that an average of 93% of heat in the combusted mixture is transferred to the water.

36. The water heater of claim 29, further comprising an anode positioned within the holding tank and electrically isolated from the holding tank.

37. A water heater comprising:

a top and a bottom;

a holding tank;

a heat exchange tube extending through the water chamber and having a combustion portion, a central tube having a top end positioned substantially at the top of the water heater and a bottom end positioned substantially at the bottom of the water heater, a joining tube extending upwardly from the bottom end of the central tube to a point approximately halfway between the top and bottom of the water heater, and a coil tube coiling downwardly therefrom around the central tube substantially to the bottom of the water heater;

a source of gas providing a flow of gas;

a gas tube partially disposed within the heat exchange tube and having an open end, the gas tube communicating with the source of gas;

a source of air providing a flow of air;

an annular space defined between the heat exchange tube and the gas tube, and communicating with the source of air;

a deflector plate, positioned within the heat exchange tube adjacent the open end of the gas tube, the deflector plate including a first series of apertures allowing fluid communication between the combustion portion of the heat exchange tube and the gas tube, and a second series of apertures allowing fluid communication between the annular space and the combustion portion of the heat exchange tube; and an ignition assembly disposed within the heat exchange tube, and adapted to ignite the combustible mixture;

whereby a flame is produced within the combustion portion of the heat exchange tube, the flame substantially not contacting the heat exchange tube.

38. The water heater of claim 37, wherein the deflector plate includes an upwardly angled perimeter that deflects the flow of air toward the second series of apertures.

39. The water heater of claim 37, wherein the source of air is a blower.

40. A water heater comprising:

a tank defining a water chamber for holding water;

a heat exchange tube at least partially disposed within the water chamber and having a substantially vertical central tube, a coil tube encircling the central tube, and a joining tube in fluid communication between the central tube and the coil tube;

a combustion chamber disposed within the central tube at least partially below the level of water within the water chamber;

a burner partially disposed within the central tube, the burner including an inner wall defining an inner space communicating between a source of gas and the heat exchange tube so as to allow a flow of gas through the inner space and into the combustion chamber, and the burner also including an outer space defined between the gas tube and the central tube portion so as to allow a flow of air into the combustion chamber;

a deflector plate including a first series of slots formed in a circular pattern and communicating between the inner space and the combustion chamber, a first series of louvers each positioned adjacent a respective one of the first series of slots and angled to direct the flow of gas in a first direction, a second series of slots formed in a circular pattern surrounding the first series of slots and communicating between the outer space and the combustion chamber, and a second series of louvers each positioned adjacent a respective one of the second series of slots and angled to direct the flow of air in a second direction substantially opposite the first direction, whereby the flow of air and the flow of gas are caused to swirl to form a substantially uniform combustible mixture within the combustion chamber; and an ignition assembly adapted to ignite the combustible mixture within the combustion chamber.

41. A water heater comprising:

a holding tank defining a water chamber;

a heat exchange conduit extending through the water chamber and having therein a combustion chamber, the combustion chamber being disposed entirely within the water chamber;

an inner wall at least partially defining an inner space, the inner space being in fluid communication with the combustion chamber;

an outer space at least partially surrounding the inner wall, the outer space being in fluid communication with the combustion chamber;

one of the inner space and the outer space being communicable with a source of air and the other of the inner space and the outer space being communicable with a source of gas so that a flow of gas mixes with a flow of air in the combustion chamber to create a combustible mixture; and an ignition assembly partially disposed within the combustion chamber, and adapted to ignite the combustible mixture, wherein said heat exchange conduit includes a central conduit, a joining conduit, and a coil conduit, said joining conduit extending from the bottom of said central conduit upwardly to the top of said coil conduit, and said coil conduit encircling said central conduit, wherein said central conduit, joining conduit, and coil conduit are in fluid flow communication with each other and are disposed within said holding tank to allow combustion gases to pass through them.

42. A water heater comprising:

a top and a bottom;

a holding tank; and a heat exchange tube disposed within said holding tank and having:

a central tube having a top end positioned substantially at the top of the water heater and a bottom end positioned substantially at the bottom of the water heater, a joining tube extending upwardly from the bottom end of the central tube to a point approximately halfway between the top and bottom of the water heater, and a coil tube coiling downwardly therefrom around the central tube substantially to the bottom of the water heater.

43. A water heater comprising:

a holding tank defining a water chamber;

a heat exchange conduit extending through the water chamber and having therein a combustion chamber, the combustion chamber being at least partially disposed within the water chamber;

an inner wall at least partially defining an inner space, the inner space being in fluid communication with the combustion chamber;

an outer space at least partially surrounding the inner wall, the outer space being in fluid communication with the combustion chamber;

one of the inner space and the outer space being communicable with a source of air and the other of the inner space and the outer space being communicable with a source of gas so that a flow of gas mixes with a flow of air in the combustion chamber to create a combustible mixture;

an ignition assembly partially disposed within the combustion chamber, and adapted to ignite the combustible mixture; and a deflector plate positioned between the inner space and the combustion chamber and between the outer space and the combustion chamber, the deflector plate being adapted to deflect the flow of gas in a first direction and the flow of air in a second direction that is substantially opposite the first direction to cause the flow of gas and the flow of air to swirl within the combustion chamber so that the combustible mixture is a substantially uniform mixture of air and gas prior to ignition of the combustible mixture.

44. The water heater of claim 43, wherein the deflector plate includes a first series of apertures communicating with the inner space, and a second series of apertures communicating with the outer space.

45. A water heater comprising:

a holding tank defining a water chamber;

a heat exchange conduit extending through the water chamber and having therein a combustion chamber portion;

an inner tube extending inside and having an end inside the heat exchange conduit, the inner tube defining an inner space inside the inner tube;

an outer space defined between the heat exchange conduit and the inner tube;

one of the inner and the outer spaces communicating with a source of gas and the other of the inner and outer spaces communicating with a source of air; and a plate extending substantially entirely across the inside of the heat exchange conduit and across the end of the inner tube to separate the outer space and inner space from the combustion chamber portion of the heat exchange tube, the plate having therein a first series of openings communicating between the inner space and the combustion chamber, and having therein a second series of openings communicating between the outer space and the combustion chamber so that air mixes with gas in the combustion chamber.

46. The water heater of claim 45, wherein the plate and combustion chamber portion are entirely disposed within the water chamber.

47. The water heater of claim 45, wherein the combustion chamber portion is disposed at a top end of the heat exchange conduit.

48. The water heater of claim 45, wherein the heat exchange conduit includes an upper end at the top of the water chamber, and a first portion extending downward from the upper end a selected distance into the water chamber, the heat exchange tube then extending upwardly a selected distance, and then coiling downwardly around the first portion toward the bottom of the water chamber, and wherein the inner tube extends into the upper end of the heat exchange conduit.

* * * * *